US006260393B1

(12) United States Patent
Engel et al.

(10) Patent No.: US 6,260,393 B1
(45) Date of Patent: Jul. 17, 2001

(54) HOLE PUNCH FOR HIGH-PRESSURE SHAPING TOOL

(75) Inventors: Bernd Engel, Burbach; Martin Lackner, Olpe, both of (DE)

(73) Assignee: Schuler Hydroforming GmbH & Co. KG, Wilnsdorf-Wilden (DE)

( * ) Notice: Subject to any disclaimer, the term of this patent is extended or adjusted under 35 U.S.C. 154(b) by 0 days.

(21) Appl. No.: 09/642,519

(22) Filed: Aug. 18, 2000

(30) Foreign Application Priority Data

Aug. 20, 1999 (DE) ..... 199 39 512

(51) Int. Cl.[7] ..... B21D 26/02
(52) U.S. Cl. ..... 72/55; 83/698.91
(58) Field of Search ..... 72/55, 58, 60, 72/61; 83/698.91, 698.31

(56) References Cited

U.S. PATENT DOCUMENTS

| | | | | |
|---|---|---|---|---|
| 3,114,280 | * | 12/1963 | Schott | 83/698.91 |
| 3,600,999 | * | 8/1971 | Daniels | 83/698.91 |
| 3,715,947 | * | 2/1973 | Weisbeck et al. | 83/698.91 |
| 5,398,533 | * | 3/1995 | Shimanovski et al. | 72/55 |
| 5,460,026 | | 10/1995 | Schafer . | |
| 5,628,220 | | 5/1997 | Schafer . | |
| 5,666,840 | * | 9/1997 | Shah et al. | 72/55 |
| 5,765,420 | | 6/1998 | Schaefer . | |
| 5,996,455 | * | 12/1999 | Haag et al. | 72/55 |
| 6,098,437 | * | 8/2000 | Kocer et al. | 72/55 |
| 6,158,122 | * | 12/2000 | Skudutis | 29/897.2 |

FOREIGN PATENT DOCUMENTS 195 06 067 3/1996 (DE) .

* cited by examiner

*Primary Examiner*—David Jones
(74) *Attorney, Agent, or Firm*—Herbert Dubno; Andrew Wilford

(57) ABSTRACT

A punch assembly for a high-pressure shaping tool having a seat opening into the tool has a guide sleeve fitted in the seat, centered on an axis, and having a radially outwardly directed outer surface radially confronting an inner surface of the seat. A punch is axially displaceable in the sleeve. A clamping element engaged radially between the inner seat surface and the outer sleeve surface retains the sleeve in the seat. The seat is formed with a radially inwardly open groove and the element is a ring engaged in the seat. A screw can serve for pressing the ring radially against the punch. Alternately the ring is pressed radially against the punch by fluid pressure applied radially outside the ring. The ring is elastomeric and is normally of C-section.

9 Claims, 2 Drawing Sheets

HOLE PUNCH FOR HIGH-PRESSURE SHAPING TOOL

FIELD OF THE INVENTION

The present invention relates to so-called high-pressure bulge forming. More particularly this invention concerns punching a hole in a workpiece produced by such high-pressure shaping.

BACKGROUND OF THE INVENTION

As described in commonly owned U.S. Pat. Nos. 5,628,220 and 5,765,420 of Schafer is it known to bulge-form a workpiece, normally a tube, by fitting it to a die and then internally pressurizing the workpiece to such a high pressure that it is deformed outward to take the shape of the tool or die. The result is a very strong cold-formed piece whose shape perfectly corresponds to that of the die.

It is often necessary to punch a hole in such a workpiece. Rather than do this as a separate step from outside, it is known from German 195 06 067 of Herberg and from U.S. Pat. No. 5,460,026 of Schafer to provide the shaping tool with a punch assembly comprising a guide sleeve whose inner surface is flush with an inner surface of the tool cavity and a punch fitting complementarily in the guide sleeve and movable between an inner position projecting into the tool slightly past the sleeve and an outer position recessed back in the sleeve.

During the initial shaping operation the punch is advanced slightly to its inner position to produce an inwardly raised region of the same shape of the punch and having an outer periphery defined by a line of reduced thickness where the material of the workpiece is stretched over the edge of the punch. The punch is then retracted and, if necessary, the pressure in the workpiece is increased to drive out the piece and cut it off at the weakened line. This procedure is extremely convenient in that it is done right in the shaping tool during the initial formation operation, and the cut-out piece ends up outside the workpiece.

The disadvantage of this system is that the subassembly formed by the punch and its guide sleeve must be meticulously mounted in the tool and secured very solidly in place. This is typically done by bolting a holding plate over the outside of these parts. Thus when they need to be changed, it is necessary to remove a relatively bulky holding plate and then pull out the sleeve and punch.

OBJECTS OF THE INVENTION

It is therefore an object of the present invention to provide an improved punch for a high-pressure shaping tool.

Another object is the provision of such an improved punch which overcomes the above-given disadvantages, that is whose punch subassembly can be easily removed and replaced.

SUMMARY OF THE INVENTION

A punch assembly for a high-pressure shaping tool having a seat opening into the tool has according to the invention a guide sleeve fitted in the seat, centered on an axis, and having a radially outwardly directed outer surface radially confronting an inner surface of the seat. A punch is axially displaceable in the sleeve. A clamping element engaged radially between the inner seat surface and the outer sleeve surface retains the sleeve in the seat.

This system solidly holds the sleeve in place, but does not require that bulky holding plate and such be mounted over the outer end of the sleeve. Thus the tool is not made substantially more massive in the region of the punch assembly.

The seat is formed with a radially inwardly open groove and the element is a ring engaged in the seat. A screw can serve for pressing the ring radially against the punch. Alternately the ring is pressed radially against the punch by fluid pressure applied radially outside the ring. The ring is elastomeric and is normally of C-section.

The element according to the invention can be at least one ball seated in the sleeve. The seat is formed with a radially inwardly open recess in which the ball is engageable. More particularly the sleeve is formed with a radially throughgoing bore receiving the ball and has a radial thickness at the bore that is smaller than a diameter of the ball so that when the punch is inserted in the sleeve it pushes out the ball so it projects radially from the sleeve. The punch has a chamfered inner end engageable with the ball.

Furthermore in accordance with the invention the tool includes an outer sleeve coaxially surrounding the inner guide sleeve. The assembly further has a clamping element engaged radially between the inner seat surface and an outer surface of the outer sleeve. This clamping element can be a ring like that usable on the inner sleeve.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
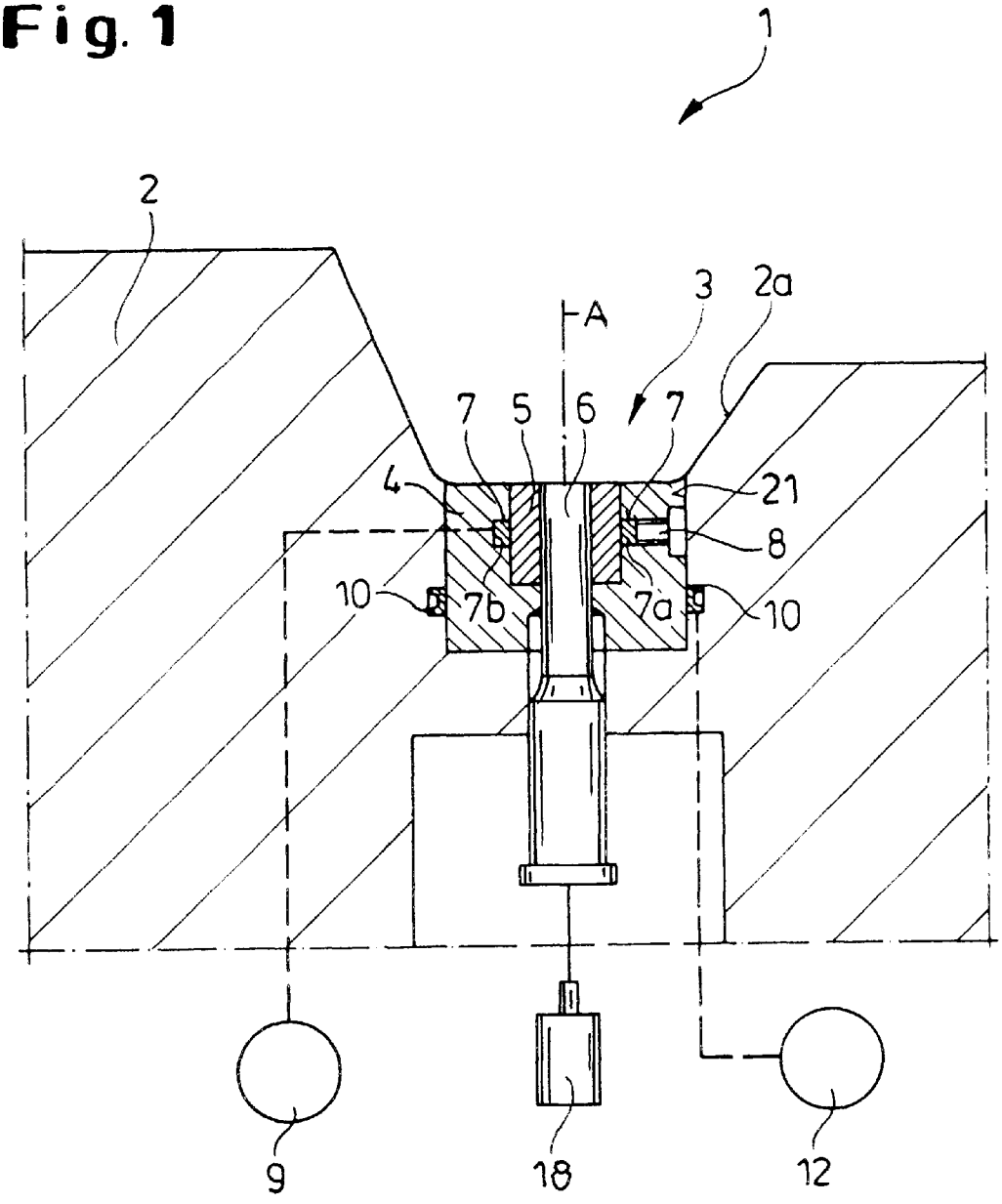
FIG. 1 is a partly diagrammatic view of a system according to the invention.

As seen in FIG. 1 a tool 1 has a tool part 2 with an interior surface 2*a* in which a punch subassembly 3 is set flush in a seat 21. This subassembly 3 has an outer body or sleeve 4 in which is set an inner guide sleeve 5 itself accommodating a punch 6. An outer periphery of the punch 6 and inner periphery of the sleeve 5 at least are centered on an axis A along which the punch 6 can be displaced by an actuator shown schematically at 18. In practice the inner and outer surfaces of the sleeves 4 and 5 and of the punch 6 are all cylindrical.

According to the invention the inner sleeve 5 is retained in the outer sleeve 4 by a retaining ring 7 that is set in a rectangular-section and radially inward open groove 19 formed in the sleeve 4 and that is pressed radially inward against the outer surface of the sleeve 5 by a screw 8 and/or by fluid pressure from a supply 9. Either way the elastomeric ring 7, which is of outwardly concave C-section, grips the sleeve 5 radially and prevents it from moving axially in the sleeve 4. Similarly another such ring 10 set in an inwardly open groove of the tool part 2 is pressed radially inward by pressurization from another source 12 to hold the outer sleeve 4 in place.

Figure 2:
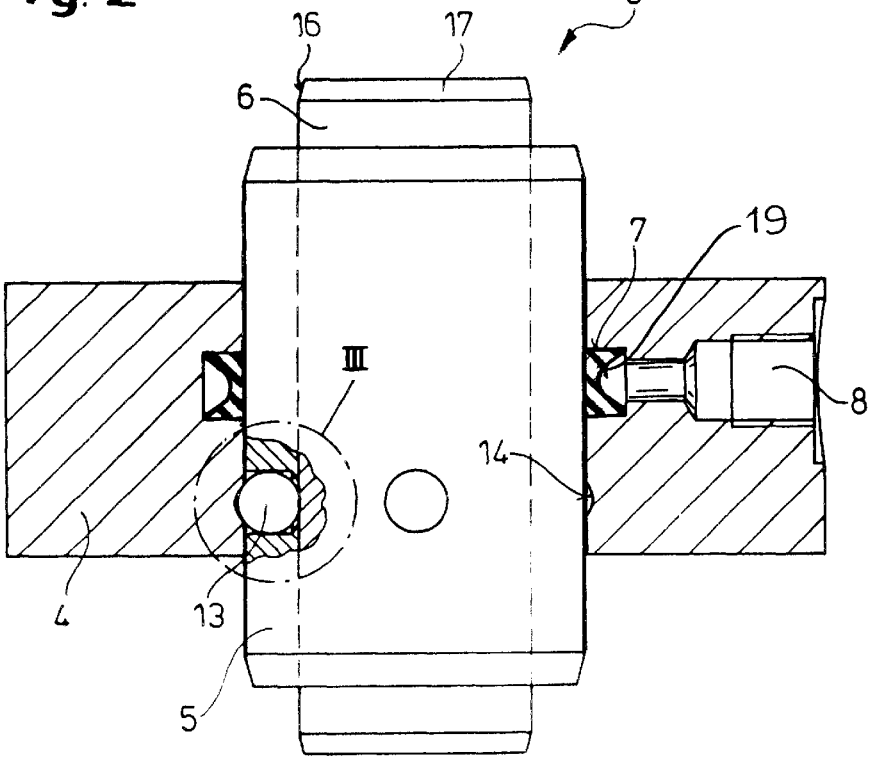
FIG. 2 is a larger-scale view of an alternative arrangement in accordance with the invention.
Figure 3:
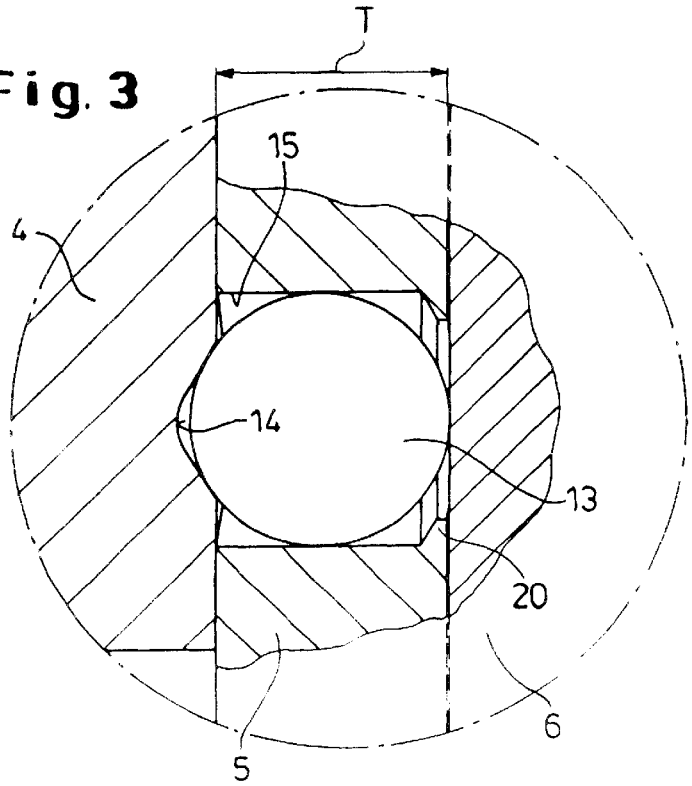
FIG. 3 is a large-scale view of the detail indicated at III in FIG. 2.

In addition FIGS. 2 and 3 show how the sleeve 5 is formed with four radially throughgoing cylindrical bores 15 each receiving a respective ball 13 having a diameter equal to slightly less than the diameter of the respective bore 15 but slightly more than a radial wall thickness T of the sleeve 5.

In addition the outer sleeve 4 is formed with a radially inwardly open groove 14 or four radially inwardly open seats. Thus with this system the sleeve 5 is inserted into the sleeve 4 without the punch 6 and is positioned so that the balls 13, which are prevented from falling out inward by a lip 20, are aligned with the seat-forming groove 14. Then the punch 6 is slid axially into place so that it pushes out the balls 13, engaging them in the groove 14 so that they axially lock the sleeve 5 in the sleeve 4. The inner end 16 of the punch 6 is formed with an inwardly tapering frustoconical chamfer 16 to facilitate this maneuver.

We claim:

1. In a high-pressure shaping tool having a seat opening into the tool, a punch assembly comprising:

a guide sleeve fitted in the seat, centered on an axis, and having a radially outwardly directed outer surface radially confronting an inner surface of the seat;

a punch axially displaceable in the sleeve; and means including a clamping element engaged radially between the inner seat surface and the outer sleeve surface.

2. The high-pressure shaping-tool punch assembly defined in claim 1 wherein the seat is formed with a radially inwardly open groove and the element is a ring engaged in the seat, the means including means for pressing the ring radially against the punch.

3. The high-pressure shaping-tool punch assembly defined in claim 2 wherein the means for pressing includes a screw bearing radially inward on the ring.

4. The high-pressure shaping-tool punch assembly defined in claim 2 wherein the means for pressing includes means for applying fluid pressure radially inward on the ring.

5. The high-pressure shaping-tool punch assembly defined in claim 2 wherein the ring is elastomeric.

6. The high-pressure shaping-tool punch assembly defined in claim 1 wherein the element is at least one ball seated in the sleeve, the seat being formed with a radially inwardly open recess in which the ball is engageable.

7. The high-pressure shaping-tool punch assembly defined in claim 6 wherein the sleeve is formed with a radially throughgoing bore receiving the ball and has a radial thickness at the bore that is smaller than a diameter of the ball, whereby when the punch is inserted in the sleeve it pushes out the ball so it projects radially from the sleeve.

8. The high-pressure shaping-tool punch assembly defined in claim 7 wherein the punch has a chamfered inner end engageable with the ball.

9. The high-pressure shaping-tool punch assembly defined in claim 1 wherein the tool includes an outer sleeve coaxially surrounding the guide sleeve, the assembly further comprising means including a clamping element engaged radially between the inner seat surface and an outer surface of the outer sleeve.

* * * * *